US005392092A

United States Patent [19]

Laidlaw et al.

[11] Patent Number: 5,392,092

[45] Date of Patent: Feb. 21, 1995

[54] PRINTING DEVICE DUPLEXING MECHANISM AND METHOD THEREFOR

[75] Inventors: Anthony G. Laidlaw; Peter Gysling; Bruce Johnson, all of Boise, Id.

[73] Assignee: Hewlett-Packard Company, Palo Alto, Calif.

[21] Appl. No.: 166,417

[22] Filed: Dec. 14, 1993

[51] Int. Cl.[6] ..... G03G 21/00

[52] U.S. Cl. ..... 355/24; 355/319; 346/134

[58] Field of Search ..... 355/319, 24; 346/134

[56] References Cited

U.S. PATENT DOCUMENTS 5,280,331 1/1994 Namiki ..... 355/318

5,296,908 3/1994 Hatano et al. ..... 355/319

*Primary Examiner*—M. L. Gellner

*Assistant Examiner*—Daniel P. Malley

[57] ABSTRACT

A duplexing image forming device which selectively directs printed pages back onto the original paper supply, flipped over with respect to the page's original position and swapping the leading edge for the trailing edge, for printing on a second side. The formatter in the image forming device then instructs the printer engine to print the second side of the page and reverses the order of data supplied to the print engine. A paper diverter is installed at the output of the fuser mechanism in the print engine. The diverter selectively diverts paper from the standard output path into a vertical gravity reversing slot through three reversing rollers. The paper is fed from the diverter up through the nip between the single driven reversing roller and an idler reversing roller. The driven reversing roller pushes the paper up into the vertical gravity reversing slot. As the trailing edge of the paper exits the nip between the driven reversing roller and the first idler roller, the trailing edge is carried by the driven reversing roller up and over that roller into the nip between the second idler reversing roller and the driven reversing roller. The driven reversing roller then forces the new leading edge of the paper through a duplexing channel where a duplex paper drive mechanism directs the paper onto the top of the existing paper supply tray.

4 Claims, 6 Drawing Sheets

PRINTING DEVICE DUPLEXING MECHANISM AND METHOD THEREFOR

BACKGROUND OF THE INVENTION

1. Technical Field

This invention generally relates to duplexing printing devices. More particularly, this invention relates to a simplified duplexing mechanism for implementation in a standard laser printer configuration, or similar hard copy output devises, with limited paper path modification.

2. Background Art

Current duplexing printing devices employ complex paper handling mechanisms and methods to print a two sided page. These devices usually utilize an additional tray for temporary storage of pages having printing on a first side or provide a second paper path to route the first printed side page around the existing paper supply. Necessarily, these devices have long paper paths which extend printing time, increase the size of the printer, require complex designs and large numbers of parts, including employing a separate reversible motor to change directions of the paper, all of which is expensive.

What is needed is a simplified design which has a shorter paper path to reduce printing time, uses a small number of extra parts and reduces the cost and size of a duplexing printer. It is therefore an object of this invention to provide a duplexing printer design which has a relatively short paper path. Another object of this invention is to reduce the number of parts necessary to produce a duplexing printer. A further object of this invention is to reduce the cost of manufacturing duplex printers. Still another object of this invention is to reduce the printing time for duplex printing. Another object of this invention is to provide a simple paper path which facilitates clearing of paper jam within the printing mechanism. Other objects will become apparent in the following disclosure.

SUMMARY OF THE INVENTION

These objects, and others, are satisfied by a design for a duplexing image forming device which selectively directs printed pages back onto the original paper supply, flipped over with respect to the page's original position and swapping the leading edge for the trailing edge, for printing on a second side. The formatter in the image forming device then instructs the printer engine to print the second side of the page and reverses the order of data supplied to the print engine. For example, if the first side of the page was printed from top to bottom and left to right, the second side of the page will be printed from bottom to top and right to left.

The duplexing device of the present invention modifies the design of a basic single side image forming apparatus in the following manner. First, a paper diverter is installed at the output of the fixing mechanism in the print engine, which in the case of a laser printer is the fuser mechanism. The diverter selectively diverts paper from the standard output path into a vertical gravity reversing slot through three reversing rollers. A set of three reversing rollers generally consists of a single driven reversing roller positioned between two idler reversing rollers. The paper is fed from the diverter up through the nip between the single driven reversing roller and an idler reversing roller. The driven reversing roller pushes the paper up into the vertical gravity reversing slot. As the trailing edge of the paper exits the nip between the driven reversing roller and the first idler roller, the trailing edge is carried by the driven reversing roller up and over that roller into the nip between the second idler reversing roller and the driven reversing roller. The driven reversing roller is either serrated or ribbed along its length to facilitate this process.

The driven reversing roller then forces the new leading edge of the paper through a duplexing channel where a duplex paper drive mechanism directs the paper onto the top of the existing paper supply tray. The net effect being that the page has been flipped over so that the side that was originally facing up is now facing down and the leading edge has been exchanged for the trailing edge.

This page is then fed again through the print engine. This time, however, the formatter prints the second side of the page in a reversed fashion so that the top of the first side will also be the top of the second side. Upon exiting the fuser mechanism, a paper diverter diverts the page up into the standard output paper path and the page exits the image forming device in a normal manner.

This simplified design utilizes the existing paper supply as part of the duplexing paper path to reduce overall paper path length, printing time and manufacturing costs. Additionally, the paper drive mechanism is powered by the parent printing device with no additional motors being required. The reversing roller assembly travels in the same direction at all times, eliminating the necessity of reversing the direction of the motor or rollers for duplex printing.

DETAILED DESCRIPTION OF THE INVENTION

Figure 1:
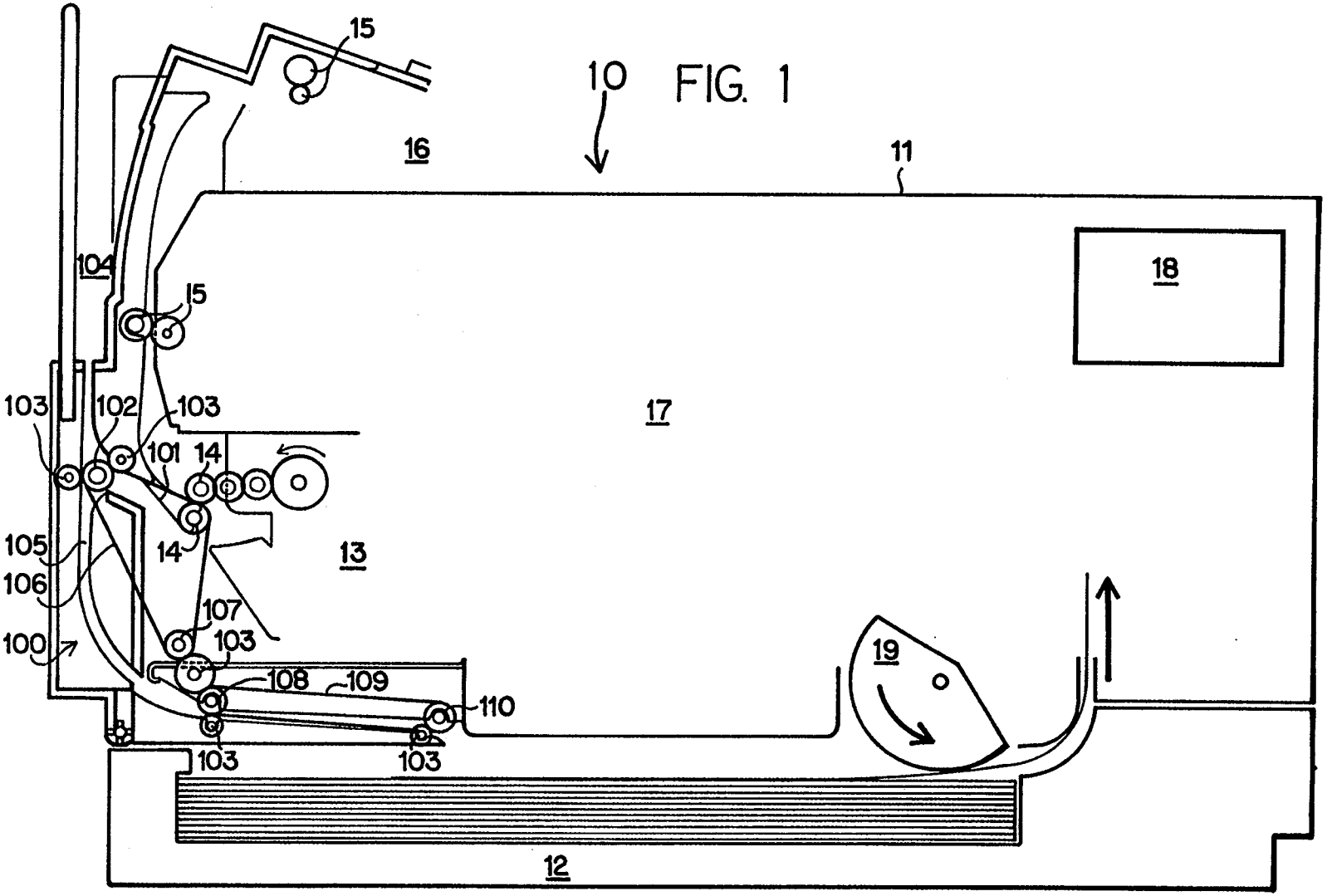

Referring now to the Figures, a duplexing mechanism 100, according to the invention, for use in conjunction with an image forming device 10, is illustrated. Image forming device 10 is here a standard laser printer, shown in schematic format, having a housing 11 containing a print engine 17, complete with a fuser unit 13. A separate formatter 18 controls printer engine 17 and supplies the engine with the data to be printed. Paper drive rollers 14 and two pairs of output rollers 15 direct the printed pages away from fuser 13 and out of image forming device 10 into a catch basin 16, formed in housing 11. A standard paper tray 12 supplies printing media, such as paper, to a pick roller 19, located at the bottom of housing 11 and defining the beginning of the overall paper path.

Pick roller 19 picks the top sheet of print media off of the supply stack in paper tray 12 and feeds the sheet into print engine 17. For purposes of this example, assume the leading edge of the media sheet represents the top of the page and the downward face surface of the sheet, as the sheet rests on the supply stack, represents the first side, of a two sided print job, to be printed on. As the sheet passes through print engine 17, an image is affixed to the first side of the sheet representing data fed to print engine 17 by formatter 18, writing in a top to bottom and left to right fashion. The image is fused to the print media by fuser 13. Upon exiting fuser 13, the sheet is either directed up and out of image forming device 10 by drive rollers 14 and output rollers 15, or into duplexing device 100 by drive rollers 14, depending on whether the print job was single sided or double sided, as is the case in this example.

Duplexing mechanism 100 uses a media or paper diverter 101 to divert a page having a first of two printed sides into the duplexing paper path portion of image forming device 10. Diverter 101 is pivotally mounted at the output of fuser 13 behind paper drive rollers 14. Diverter 101 is selectively pivotable in response to formatter 18 and engine 17 between a standard page output position, as is shown in FIGS. 1, 3, 4, 5 and 6, and a duplexing position shown in FIG. 2. As the leading edge of the sheet exits fuser 13, a sensor, which is not shown here, detects the presence of the sheet and notifies the printer controller, in this example part of formatter 18, which subsequently lowers diverter 101 into the duplexing position.

Figure 2:
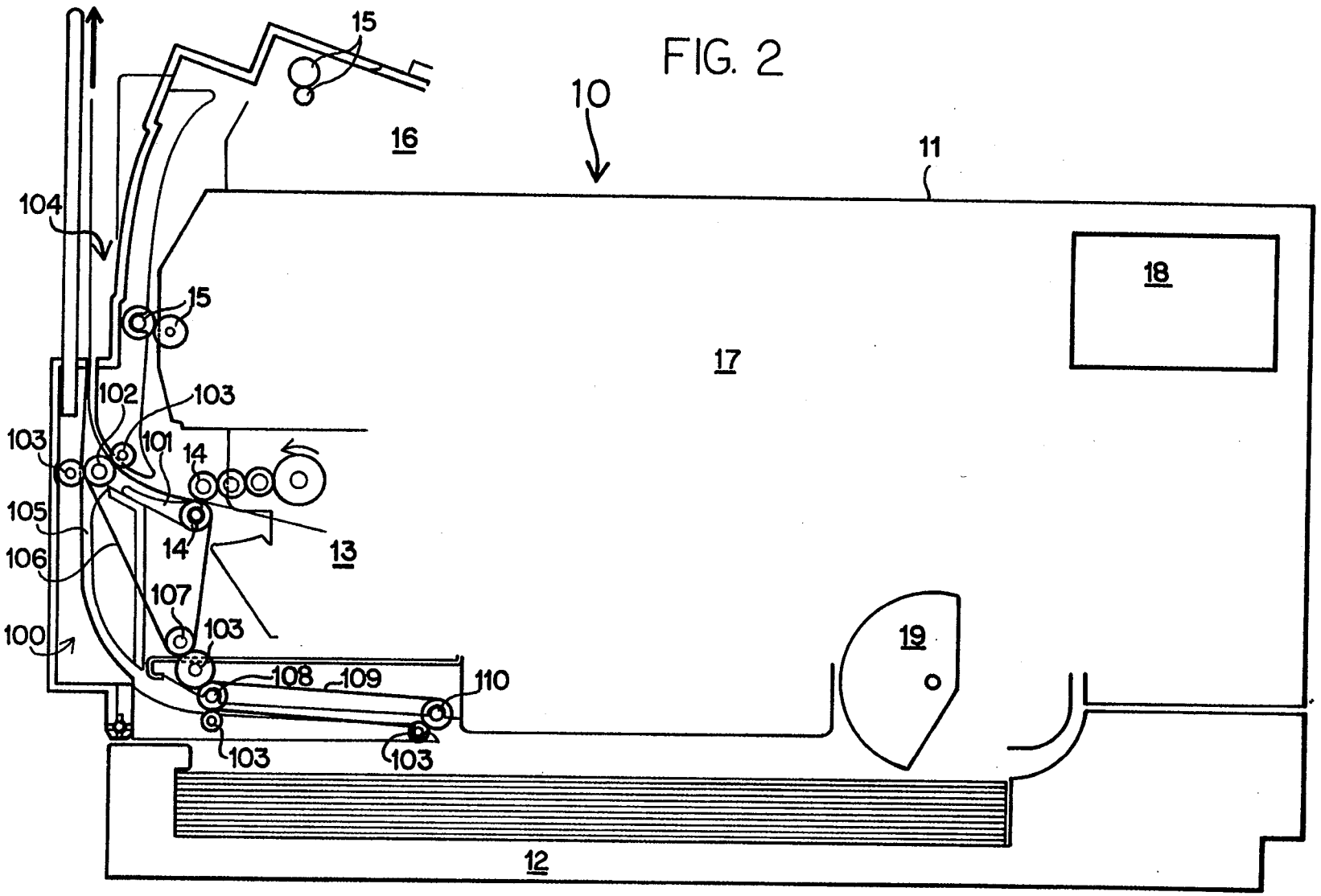
FIGS. 2, 3, 4, 5 and 6 are schematic side views of an image forming device utilizing the duplexing mechanism of the invention, showing different steps of the process.

The sheet is directed into duplexing device 100 as is shown in FIG. 2. Drive rollers 14 continue to push the sheet into duplexing mechanism 100 forcing the leading edge of the sheet into the nip between a first pair of reversing rollers, main reversing roller 102 and right idler reversing roller 103. Main reversing roller 102 is powered by a first drive belt 106 which drivingly interconnects bottom drive roller 14, main reversing roller 102 and duplex drive roller 107. Main reversing roller 102 is ribbed or otherwise serrated along its length for reasons which will be more apparent in the following disclosure. Drive rollers 14 and main reversing roller 102 continue to drive the sheet until the sensor in fuser 13 detects the trailing edge of the sheet. The controller then flips diverter 101 up into its standard page output position, after a specified period of time to allow the trailing edge of the page to clear diverter 101.

Figure 3:
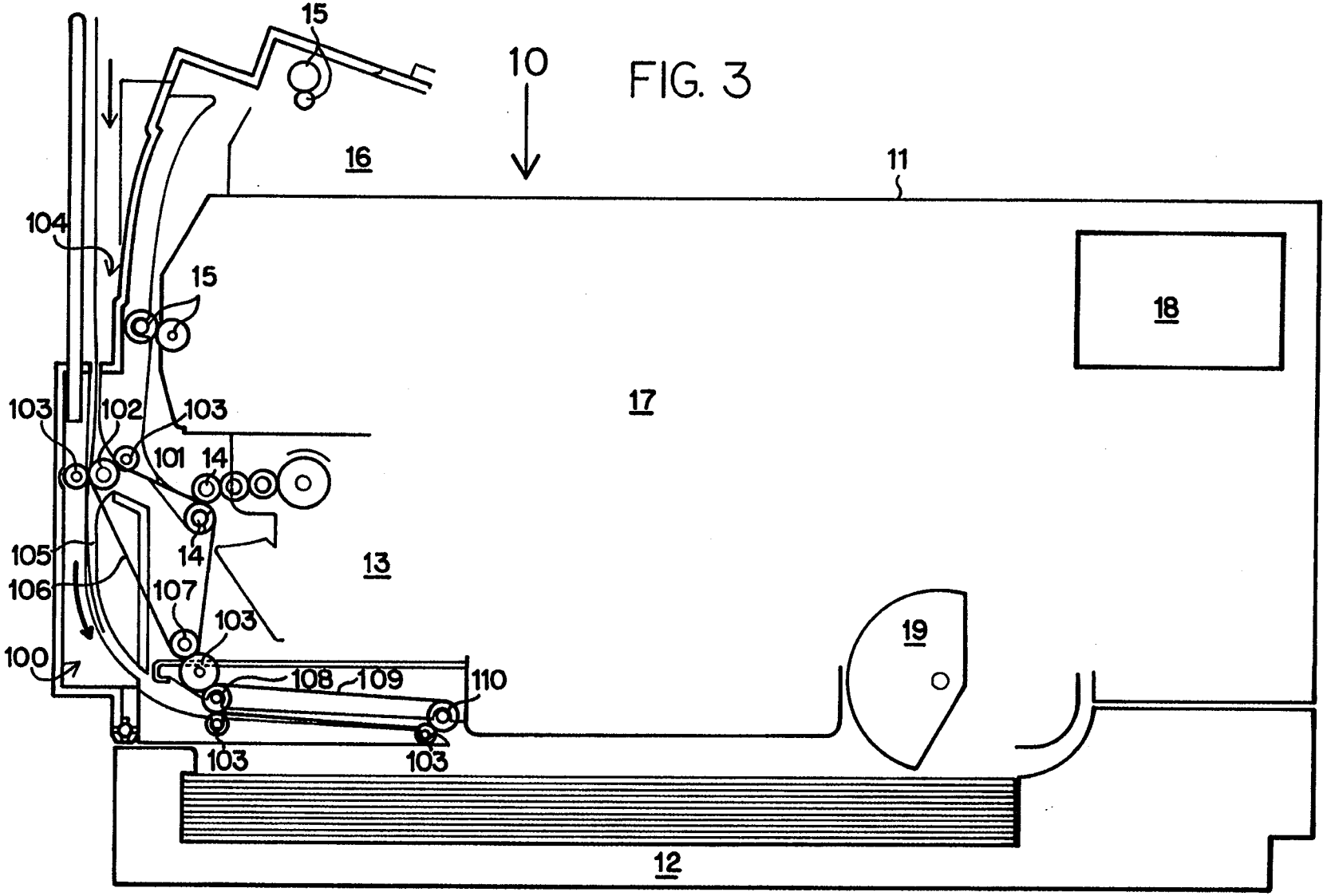

Main reversing roller 102 continues to pull the sheet, directing it upward into a vertically disposed gravity reversing slot 104 formed within housing 11. Slot 104 is shown here being open to the outside environment to aid in clearing of paper jams and the like, however, slot 104 could just as easily be enclosed or covered by a removable panel or hinged cover. The paper continues to advance up into gravity reversing slot 104 until the trailing edge of the sheet clears the nip between main reversing roller 102 and first reversing idler roller 103. The ribs or serrations on main reversing roller 102 grabs the trailing edge of the sheet and carries it up and over the top of main reversing roller 102 and into the nip between main reversing roller 102 and left idler reversing roller 103. At this point, the trailing edge becomes the leading edge, and vice-versa, as the page is pulled through left idler reversing roller 103 and main reversing roller 102. This reversing roller pair continues to direct the page into and through duplexing channel 105. Duplexing channel 105 directs the page down around the back of housing 11 toward paper supply tray 12, as is shown in FIG. 3.

Duplex drive roller 107 drives an intermediate idler roller 103 located in the lower portion of duplexing mechanism 100. Intermediate idler roller 103 in turn drives a first duplex paper drive roller 108. A fourth idler roller 103 is closely positioned directly below first duplex paper drive roller 108. As the page is pushed through duplexing channel 105, the new leading edge is forced into the nip between fourth idler roller 103 and first duplex paper drive roller 108.

Figure 4:
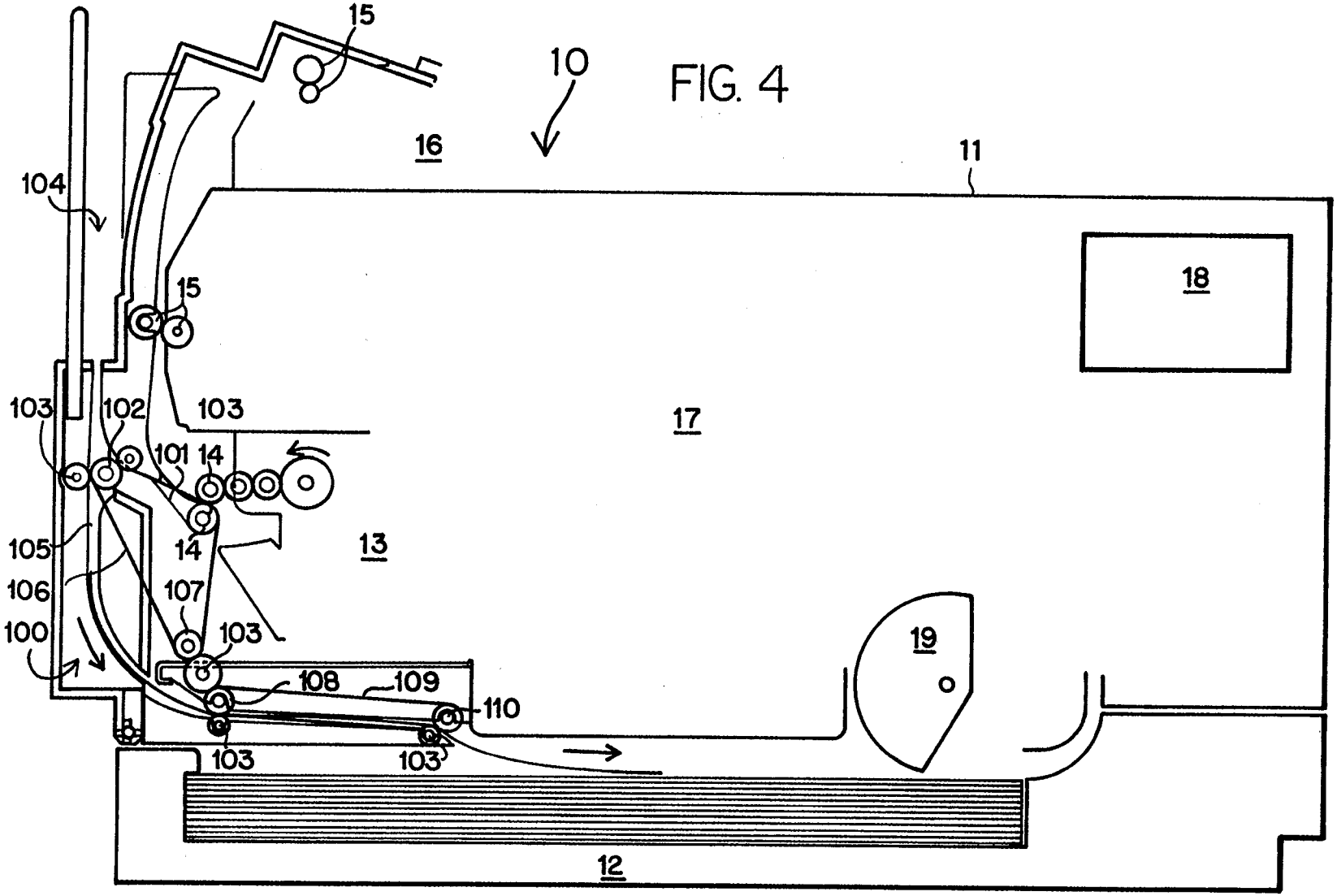
Figure 5:
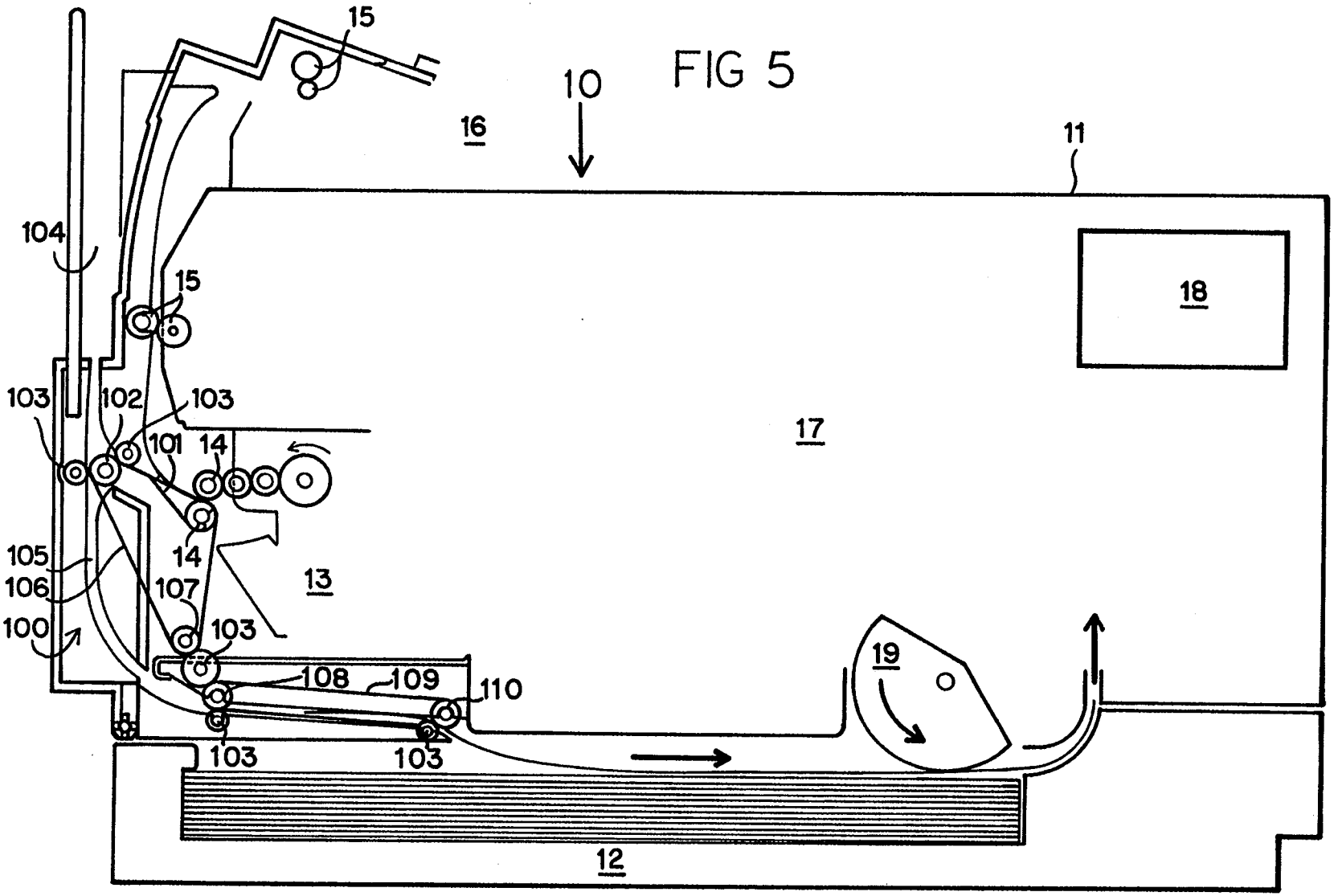

A second duplex paper drive roller 110 is positioned at the end of duplexing channel 105. Second duplex paper drive roller 110 is driven from first duplex drive roller 108 via second drive belt 109. A fifth idler roller 103 is closely positioned directly below second duplex paper drive roller 110. As the page is pulled through the last portion of duplexing channel 105 the leading edge of the page will engage the nip between fifth idler roller 103 and second duplex paper drive roller 110. This roller pair directs the page onto the top of paper supply tray 12, as is shown in FIG. 4, and positions it for engagement by pick roller 19, shown in FIG. 5.

Figure 6:
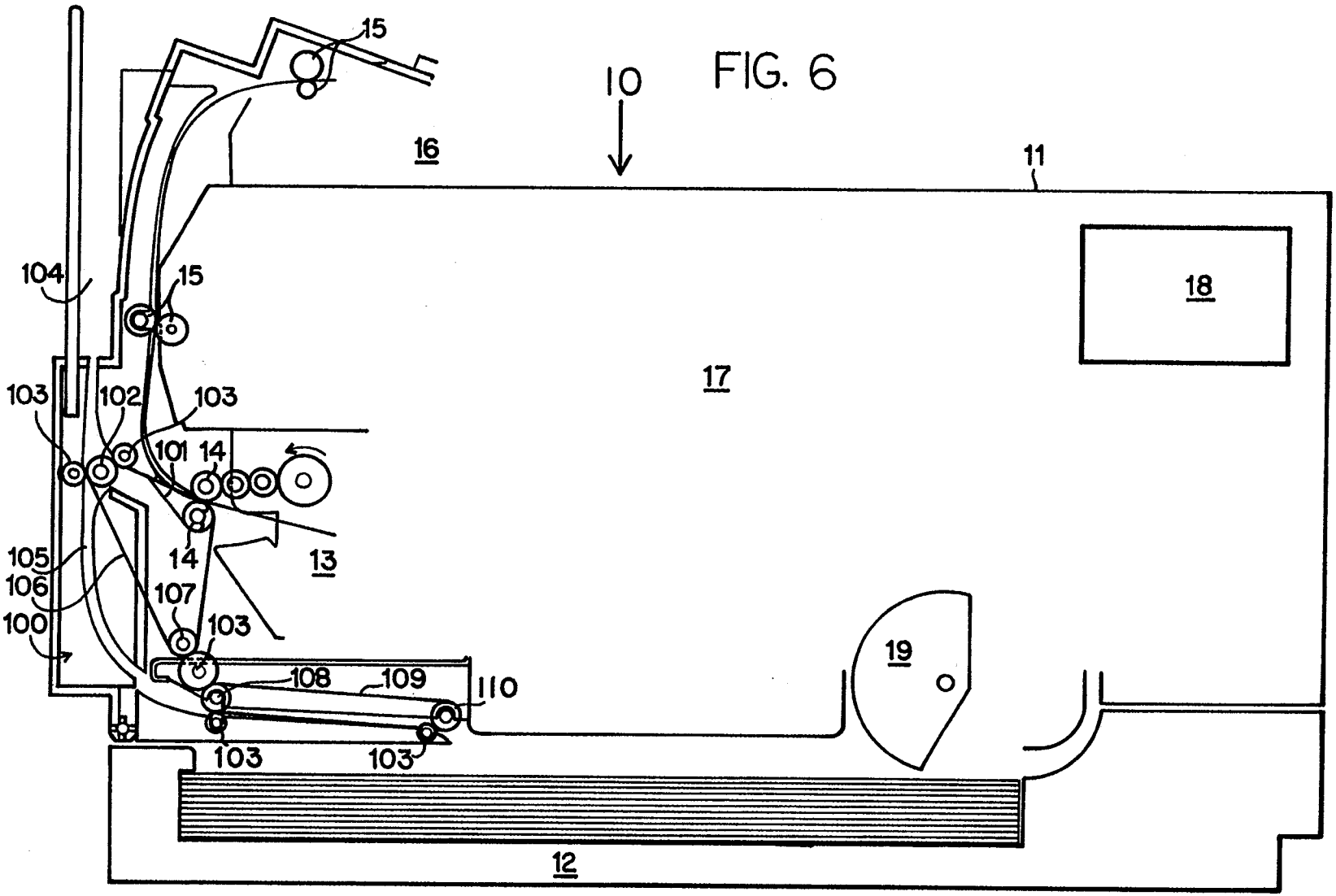

The page is now positioned with what was originally the trailing edge as the leading edge and with what was the down facing surface as the upward facing surface. Pick roller 19 again picks the top sheet of print media off of the supply stack in paper tray 12 and feeds the sheet into print engine 17. However, this time as the sheet passes through print engine 17, the image that is affixed to the second side of the sheet representing data fed to print engine 17 by formatter 18, writing in a bottom to top and right to left fashion. This image is fused to the print media by fuser 13. Upon exiting fuser 13, the sheet is directed up and out of image forming device 10 by drive rollers 14 and output rollers 15 into catch basin 16, as is shown in FIG. 6.

While all of the rollers in this description have been described as being single rollers spread across the width of the page, it should be apparent to those skilled in the art that multiple concentric rollers can and are used across the width of the page. Additionally, other drive configurations are possible and other sensing and control methods can be implemented within the scope of this invention.

While there is shown and described the present preferred embodiment of the invention, it is to be distinctly understood that this invention is not limited thereto but may be variously embodied to practice within the scope of the following claims.

We claim:

1. An image forming apparatus for printing on two sides of a page of print media which comprises:

a housing;

print engine means, for affixing an image representing data to the page of print media, being positioned within the housing;

formatter means for supplying data to the print engine means, the formatter means being configured to supply a first set of data representing the first side of the page in a first order and to supply a second set of data representing the second side of the page in a second order which is reverse with respect to the first order;

print media supply means, for supplying pages of print media to the print engine means from a stack of print media pages having leading edges and trailing edges; being attached to the housing;

printed page output means for directing the page from the print engine means out of the housing;

diverter means for diverting a page, having an image on a first side of the page, away from the printed page output means; and means for placing the diverted page back on the top of the stack of print media pages and reorienting the page in a flipped over state with respect to its original position on the stack having the original trailing edge of the page now being the leading edge.

2. The device of claim 1 wherein the means for placing the diverted page back on the top of the stack of print media pages and reorienting the page comprises:

three reversing rollers wherein one of the three reversing rollers is defined as the main reversing roller and a second of the three rollers, together with the main reversing roller, define a first pair of reversing rollers for receiving the original leading edge of the page therebetween;

a gravity reversing slot for receiving the page from the first pair of reversing rollers and holding it in a generally vertical position;

the three rollers further defining a second pair of reversing rollers by a third of the three rollers together with the main reversing roller, for receiving the original trailing edge therebetween after the page is fully engaged in the gravity reversing slot; and a duplexing channel for receiving the page from the second pair of reversing rollers and directing the page back on the top of the stack of print media pages.

3. A method of printing on both sides of a page using an image forming device having a print engine, a formatter for supplying data to the print engine representing images to be printed on both sides of the page, page output means and a page supply means including a stack of print media having leading edges and trailing edges, comprising the steps of:

first, sending a first set of data to the print engine in a first order;

then, affixing an image represented by the first set of data to a first side of the page;

then, diverting the page away from the page output means;

then, exchanging the leading edge of the page for the trailing edge of the page;

then, placing the page back on the top of the stack of print media, but in a flipped over orientation with respect to its original position;

sending a second set of data to the print engine in a second order which is reverse with respect to the first order;

then, affixing an image represented by the second set of data to a second side of the page; and outputting the page.

4. An image forming apparatus for printing on two sides of a page of print media which comprises:

a housing;

print engine means, for affixing an image representing data to the page of print media, being positioned within the housing;

formatter means for supplying data to the print engine means, the formatter means being configured to supply a first set of data representing the first side of the page in a first order and to supply a second set of data representing the second side of the page in a second order which is reverse with respect to the first order;

print media supply means, for supplying pages of print media to the print engine means from a stack of print media pages having leading edges and trailing edges; being attached to the housing;

printed page output means for directing the page from the print engine means out of the housing;

diverter means for diverting a page, having an image on a first side of the page, away from the printed page output means;

three reversing rollers wherein one of the three reversing rollers is defined as the main reversing roller and a second of the three rollers, together with the main reversing roller, define a first pair of reversing rollers for receiving the original leading edge of the page therebetween;

a gravity reversing slot for receiving the page from the first pair of reversing rollers and holding it in a generally vertical position;

the three rollers further defining a second pair of reversing rollers by a third of the three rollers together with the main reversing roller, for receiving the original trailing edge therebetween after the page is fully engaged in the gravity reversing slot; and a duplexing channel for receiving the page from the second pair of reversing rollers and directing the page back to the print engine means in a flipped over state having the original trailing edge of the page now being the leading edge.

* * * * *